US008303382B2

(12) United States Patent
Wang et al.

(10) Patent No.: US 8,303,382 B2
(45) Date of Patent: Nov. 6, 2012

(54) POLISHING PAD AND METHOD OF FABRICATION

(75) Inventors: Yu-Piao Wang, Jubei (TW); Yun-Liang Ouyang, Hukou Township, Hsinchu County (TW)

(73) Assignee: IV Technologies Co., Ltd., Taichung (TW)

( * ) Notice: Subject to any disclaimer, the term of this patent is extended or adjusted under 35 U.S.C. 154(b) by 1246 days.

(21) Appl. No.: 11/542,270

(22) Filed: Oct. 4, 2006

(65) Prior Publication Data

US 2007/0093191 A1 Apr. 26, 2007

(30) Foreign Application Priority Data

Oct. 20, 2005 (TW) ..... 94136780 A

(51) Int. Cl.
*B24D 11/00* (2006.01)

(52) U.S. Cl. ..... 451/533; 451/41; 451/526; 451/527; 451/528

(58) Field of Classification Search ..... 451/41, 451/526, 528, 527
See application file for complete search history.

(56) References Cited

U.S. PATENT DOCUMENTS

| | | | | |
|---|---|---|---|---|
| 5,489,233 | A | 2/1996 | Cook et al. | |
| 6,022,268 | A | 2/2000 | Roberts et al. | |
| 6,217,426 | B1 | 4/2001 | Tolles et al. | |
| 6,220,942 | B1 | 4/2001 | Tolles et al. | |
| 6,290,589 | B1 | 9/2001 | Tolles | |
| 6,428,405 | B1 | 8/2002 | Tsuchiya | |
| 6,544,104 | B1 | 4/2003 | Koike et al. | |
| 6,824,447 | B2 * | 11/2004 | Takahashi et al. | 451/6 |
| 6,830,090 | B2 * | 12/2004 | Foster | 156/581 |
| 6,838,169 | B2 * | 1/2005 | Obeng | 428/354 |
| 6,852,020 | B2 | 2/2005 | Petroski et al. | |
| 6,913,527 | B2 * | 7/2005 | He | 451/259 |
| 6,949,020 | B2 * | 9/2005 | Xu et al. | 451/533 |
| 7,090,572 | B2 * | 8/2006 | Ito | 451/458 |
| 7,101,275 | B2 | 9/2006 | Roberts et al. | |
| 7,132,033 | B2 | 11/2006 | Boldizar et al. | |
| 7,137,868 | B2 * | 11/2006 | Chang et al. | 451/5 |
| 2004/0142638 | A1 * | 7/2004 | Petroski et al. | 451/41 |

FOREIGN PATENT DOCUMENTS

| | | |
|---|---|---|
| CN | 1357434 A | 12/2000 |
| CN | 1606133 A | 4/2005 |
| CN | 1660543 A | 8/2005 |
| CN | 2007100188451 | 5/2008 |
| TW | 587286 | 5/2004 |

OTHER PUBLICATIONS

Office Action (Notice of Allowance) issued in corresponding Taiwanese Application dated Sep. 3, 2007.

* cited by examiner

*Primary Examiner* — Joseph J Hail
*Assistant Examiner* — Shantese McDonald
(74) *Attorney, Agent, or Firm* — Ditthavong Mori & Steiner, P.C.

(57) ABSTRACT

A polishing pad, comprising a mounting surface and an opposing polishing surface with a polishing pattern having at least one aperture thereon, is formed with an adhesive layer adhered to the mounting surface with uniform adhesive strength therebetween. Embodiments include applying an adhesive layer to the mounting surface with uniform pressure prior to forming the polishing pattern on the polishing surface. Embodiments also include forming the polishing pattern having at least one aperture, forming a fitter having a surface pattern opposite to the polishing pattern and having a projection, positioning the fitter on the polishing pattern so that the projection fills the aperture in the polishing pattern forming a composite having substantially parallel opposing surfaces, applying pressure to bond the adhesive layer to the mounting surface with substantially uniform adhesive strength therebetween, and removing the fitter.

28 Claims, 5 Drawing Sheets

POLISHING PAD AND METHOD OF FABRICATION

FIELD OF THE INVENTION

The present invention relates to polishing pads and to methods of fabricating polishing pads. The present invention is particularly applicable to polishing pads for use in chemical mechanical polishing (CMP) for processing semiconductor wafers.

BACKGROUND ART

As the dimensions of semiconductor device features continue to shrink into the deep submicron range, it becomes increasingly more difficult to form the features with high dimensional accuracy. The minimum size of a feature depends upon the chemical and optical limits of a particular lithography system, notably the depth of focus of a particular tool. Therefore, it is of utmost importance to provide an extremely flat wafer or substrate surface during fabrication of integrated circuits as well as other electronic devices.

Conventional practices include planarizing a substrate surface to remove high topography, surface defects, scratches or imbedded particles, as by CMP, which typically involves introducing a chemical slurry during polishing to facilitate higher removal rates and selectivity between films on the substrate surface. Typically, CMP involves holding a substrate against a polishing pad under controlled pressure, temperature and rotational speed of the pad in the presence of the slurry or other fluid medium. Typical pads are constructed with a proper balance between stiffness or rigidity for wafer smoothness and compressibility or flexibility for uniformity, as by forming a composite polishing pad with an upper rigid layer and an underlying flexible layer.

In accordance with conventional practices, a polishing pad 60 is provided, as illustrated in FIG. 6A, having a polishing surface comprising at least one concavity or aperture 61 adjacent a convexity or projection 62. The aperture or recessed portion of the surface pattern provides slurry on the wafer surface during CMP.

In accordance with conventional practices, the surface pattern containing aperture 61 and projection 62 is typically formed by mechanical, or chemical techniques. Subsequently, an adhesive layer 63 is adhered to the back surface of the polishing layer by application of pressure, such as rolling, illustrated in FIG. 6B. During rolling pressure is applied from both upper surface and lower surface as illustrated by arrows 64 and 65, respectively.

Such conventional techniques are problematic in that during application of the adhesive layer 63, which is typically a pressure sensitive adhesive, uniform pressure is not applied across the entire interface between the adhesive layer and the back surface of the polishing layer. This is because less pressure is applied to the recessed portion of the surface pattern B than the projection portion A during pressing. Therefore, adhesion between the adhesive layer and the back surface of the polishing layer underlying or corresponding to the recessed portion B is relatively weaker than adhesion between the adhesive layer and the back surface underlying projection portion A. During CMP, a sheer force is applied tending to delaminate the adhesive layer due to the weaker adhesion underlying portion B, thereby limiting the lifetime of the polishing pad. Moreover, delamination during CMP may damage the semiconductor wafer undergoing planarization.

Accordingly, a need exists for polishing pads having a surface pattern and an opposing mounting surface with an adhesive layer uniformly adhered thereto, and for methodology enabling the fabrication of such polishing pads. There exists a particular need for polishing pads having a surface pattern comprising apertures and projections and an opposing mounting surface with an adhesive layer adhered thereto with substantially uniform adhesive strength in regions corresponding to both the apertures and the projections, and for enabling methodology.

DISCLOSURE OF THE INVENTION

An advantage of the present invention is a method of fabricating polishing pads having a surface pattern comprising at least one aperture and an opposing mounting surface having an adhesive layer adhered thereto with uniform adhesive strength across the mounting surface.

Another advantage of the present invention is a method of fabricating polishing pads having a polishing surface with a pattern comprising at least one concavity or aperture and at least one convexity or projection and an opposing mounting surface with an adhesive layer adhered thereto with substantially uniform adhesive strength underlying the concavity or aperture and convexity or projection.

A further advantage of the present invention is a polishing pad comprising a polishing surface and an opposing mounting surface having an adhesive layer adhered to the mounting surface with substantially uniform adhesive strength therebetween.

Yet another advantage of the present invention is a polishing pad comprising a polishing surface with a surface pattern containing at least one concavity and at least one convexity, and an opposing mounting surface with an adhesive layer adhered thereto with substantially uniform adhesive strength underlying the concavity and the convexity.

According to the present invention, the foregoing and other advantages are achieved in part by a method of fabricating a polishing pad, the method comprising sequentially: providing a polishing layer having a polishing surface and a back surface opposing the polishing surface; adhering a first adhesive layer to the back surface; and forming a polishing pattern having at least one aperture and at least one projection on the polishing surface.

Another advantage of the present invention is a method of fabricating a polishing pad, the method comprising: providing a polishing layer having a polishing surface and a back surface opposing the polishing surface; forming a polishing pattern having at least one aperture and at least one projection on the polishing surface; forming a fitter having a first surface, comprising a surface pattern opposite to the polishing pattern including at least one projection, and a second surface opposing the first surface; aligning the fitter with the polishing pattern such that the projection on the first surface of the fitter is aligned with the aperture on the polishing surface; and adhering the first adhesive layer to the back surface of the polishing layer.

A further advantage of the present invention is a method of fabricating a polishing pad, the method comprising: forming a polishing layer comprising a back surface and an opposing polishing surface having a polishing pattern with at least one convex surface portion ("A") and at least one adjacent concave surface portion ("B"); and adhering an adhesive layer to the bottom surface by applying greater pressure to portion B than to portion A.

Yet another advantage of the present invention is a polishing pad comprising: a polishing layer having a first surface and an opposing second surface, the first surface having a polishing pattern formed thereon, the polishing pad comprising at least one concave surface portion; and an adhesive layer adhered to the second surface forming an interface therebetween, wherein adhesive strength across the interface does not vary by more than 45%.

Yet a further advantage of the present invention is a polishing pad comprising: a polishing layer having a first surface with a polishing pattern formed thereon and an opposing second surface, the polishing pattern comprising at least one convex surface portion ("A") and at least one adjacent concave surface portion ("B"); and an adhesive layer adhered to the second surface forming an interface therebetween, wherein adhesive strength at the interface underlying portion A and portion B does not vary by more than 45%.

Yet a further advantage of the present invention is a polishing pad comprising: a polishing layer having a first surface with a polishing pattern formed thereon and an opposing second surface, the polishing pattern comprising at least one convex surface portion ("A") and at least one adjacent concave surface portion ("B"); and an adhesive layer adhered to the second surface forming an interface therebetween, wherein a first adhesive strength at the interface underlying portion B is higher than a second adhesive strength at the interface underlying portion A by at least 5%.

Embodiments of the present invention include the use of pressure sensitive adhesive layers, including composite pressure sensitive adhesive layers. Embodiments of the present invention further include the formation of polishing pads having composite layers, including a polishing layer having a relatively high degree of rigidity or stiffness and an underlying bottom layer having a relatively high degree of flexibility.

Embodiments of the present invention utilizing a fitter include fitting the surface pattern of the fitter into the polishing pattern tightly such that a projection on the surface pattern of the fitter is within the aperture, thereby presenting a second surface of the fitter which is substantially parallel to the back surface of the polishing layer, and applying pressure to bond the adhesive layer to the polishing layer with substantially uniform adhesive strength therebetween.

Additional advantages of the present invention will become readily apparent to those skilled in the art from the following detailed description, wherein embodiments of the present invention are described, simply by way of illustration of the best mode contemplated for carrying out the present invention. As will be realized, the present invention is capable of other and different embodiments and its several details are capable of modifications in various obvious respects, all without departing from the present invention. Accordingly, the drawings and description are to be regarded as illustrative in nature, and not as restrictive.

BRIEF DESCRIPTION OF THE DRAWINGS

In FIGS. 1A and 1B, in FIGS. 3A through 3D, in FIGS. 4A and 4B, in FIGS. 5A through 5C, and in FIGS. 6A and 6B, similar features are denoted by similar reference characters.

DESCRIPTION OF THE INVENTION

Figure 1A:
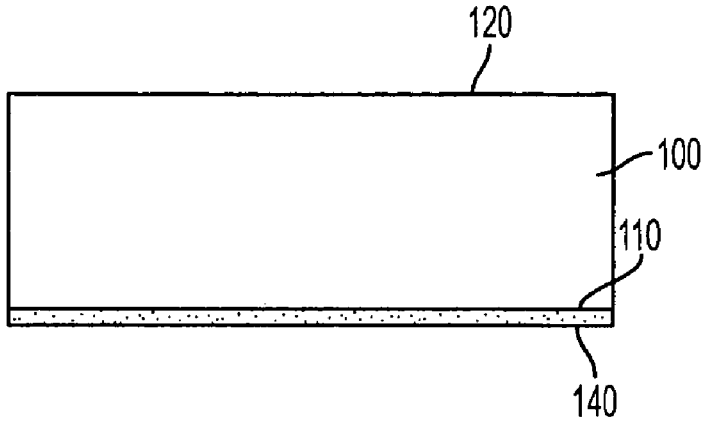
FIGS. 1A and 1B are side sectional views schematically illustrating sequential phases of a method in accordance with an embodiment of the present invention.

The present invention addresses and solves problems attendant upon conventional polishing pads employed for CMP. Specifically, the nonuniform adhesive strength across the interface between the mounting surface of the polishing pad and the adhesive layer causes delamination from the pattern during CMP, thereby limiting the useful life of the polishing pad and damaging the substrate undergoing CMP. It was found that nonuniform adhesive strength across the interface stems from the lack of uniform pressure applied during adhesion of the adhesive layer due to the polishing pattern on the polishing surface which comprises at least one concavity or indentation typically provided for slurry distribution. The present invention addresses and solves such nonuniform adhesion problems by providing a polishing pad having an adhesive layer applied to the mounting surface thereof with uniform adhesion and enabling methodology.

In accordance with embodiments of the present invention, the adhesive layer is applied to the back surface of the polishing layer under conditions such that substantially uniform pressure is applied across the entire interface between the adhesive layer and back surface, thereby preventing delamination. of the adhesive layer during CMP and consequential damage to the wafer undergoing processing. In an embodiment of the present invention, the adhesive layer, typically a pressure sensitive adhesive, is applied to the back surface of a polishing layer before a surface polishing pattern is formed on the polishing surface. Accordingly, at the time pressure is applied to adhere the adhesive layer to the mounting surface the substantially planar polishing surface is substantially parallel to the substantially planar mounting surface. Therefore, uniform pressure is applied across the entire interface between the mounting surface and the adhesive layer.

In another embodiment of the present invention, the polishing layer is provided with a surface polishing pattern containing at least one concavity or aperture. Subsequently, a fitter is prepared having a surface pattern which is opposite to or the mirror image of the polishing pattern, i.e., the surface pattern of the fitter contains apertures and projections corresponding to the projections and apertures, respectively, on the polishing pattern. The fitter is then aligned with the polishing layer such that the projections and apertures of the surface pattern on the fitter correspond to the apertures and projections, respectively, of the polishing pattern. In an embodiment of the present invention, the surface pattern of the fitter is snug fitted directly into the polishing pattern such that the projections on the surface pattern of the fitter extend into and fill apertures of the polishing pattern and the projections on the polishing pattern extend into and fill the apertures of the surface pattern of the fitter. The opposite side of the fitter is essentially planar and parallel to the back surface of the polishing layer, thereby enabling uniform pressure to be applied throughout the interface between the adhesive layer and the back surface of the polishing layer.

Figure 1B:
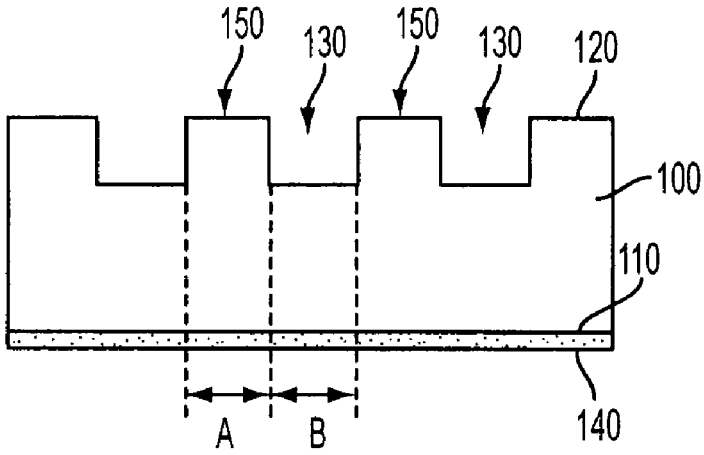

A method in accordance with an embodiment of the present invention is schematically illustrated in FIGS. 1A and 1B. Adverting to FIG. 1A, a polishing layer 100 is provided with a substantially planar first surface 120, on which a polishing pattern is to be formed, and an opposing back surface 110. Surface 110 and surface 120 are essentially parallel. Prior to forming a polishing pattern on the polishing surface 120 of the polishing layer 100, an adhesive layer 140 is applied to the back surface 110. Adhesive layer 140 can comprise a pressure sensitive adhesive having a release layer. Adhesive layer 140 is adhered to back surface 110 by application of pressure, as by rolling, during which substantially uniform pressure is applied across the interface between back surface 110 and adhesive layer 140, resulting in substantially uniform adhesive strength across the entire interface.

Subsequently, a polishing pattern is provided on polishing surface 120 comprising at least one aperture. As illustrated in FIG. 1B, a polishing pattern is provided on polishing surface 120 comprising a plurality of concavities or apertures 130 with adjacent convexities or projections 150. Advantageously, the adhesive strength at interface between back surface 110 and adhesive layer 140 underlying apertures 130 (B) is substantially the same as the adhesive strength at the interface underlying projections 150 (A). Alternatively, instead of applying uniform pressure across the interface between back surface 110 and adhesive layer 140, before forming apertures 130 (B) and projections 150 (A), a first pressure applied to the regions predetermined to form apertures 130 (B) is higher than a second pressure applied to the regions predetermined to form projections 150 (A). Thereby, the first adhesive strength at the interface between back surface 110 and adhesive layer 140 underlying apertures 130 (B) is higher than the second adhesive strength at the interface underlying projections 150 (A). In an embodiment, the first adhesive strength is higher than the second adhesive strength by at least 5%, such as 10% to about 40%.

Figure 2:
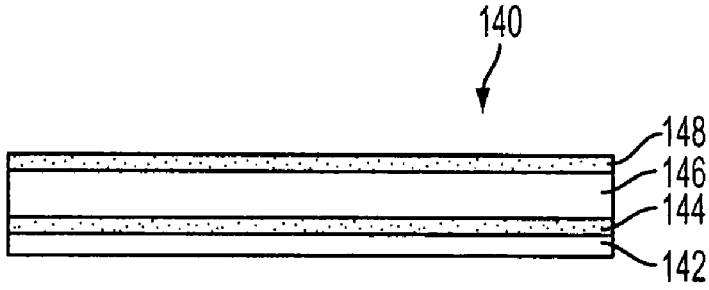
FIG. 2 schematically illustrates a composite adhesive layer suitable for use in embodiments of the present invention.

Adhesive layers employed in embodiments of the present invention can comprise any adhesive layer employed in fabricating polishing pads. For example, an adhesive layer suitable for use in embodiments of the present invention is schematically illustrated in FIG. 2 and comprises a layer of pressure sensitive adhesive 148, a base material 146, a pressure sensitive adhesive 144, and a release layer 142 at the bottom. Release layer 142 can be released when applying the polishing pad to a platen. The base material 146, usually referred to as the "carrier film", is typically a polymer, such as polyester (PET), or high density polyethylene (HDPE). Such adhesive layers are usually termed "double-sided tape" or "double-sided adhesive tape" and commercially available from various vendors.

Another embodiment of the present invention is schematically illustrated in FIGS. 3A through 3D. Adverting to FIG. 3A, a polishing layer 300 has a back surface 310 and a polishing surface having a surface pattern formed thereon comprising a plurality of concavities or apertures 330 and a plurality of convexities or projections 320.

Figure 3A:
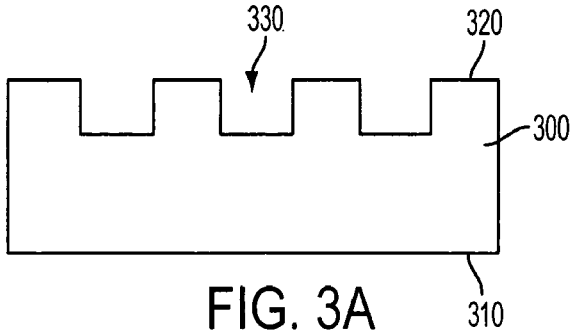
FIGS. 3A through 3D are side sectional views schematically illustrating sequential phases of a method in accordance with another embodiment of the present invention.
Figure 3B:
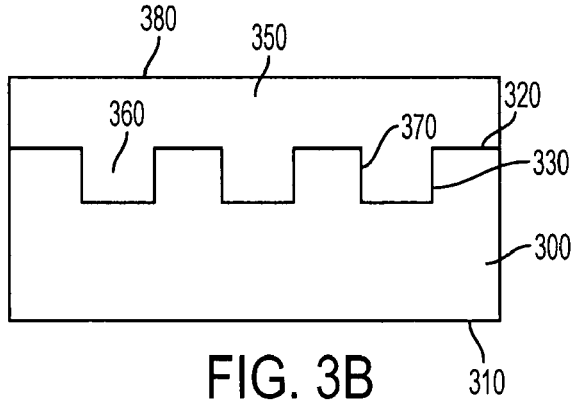
Figure 3C:
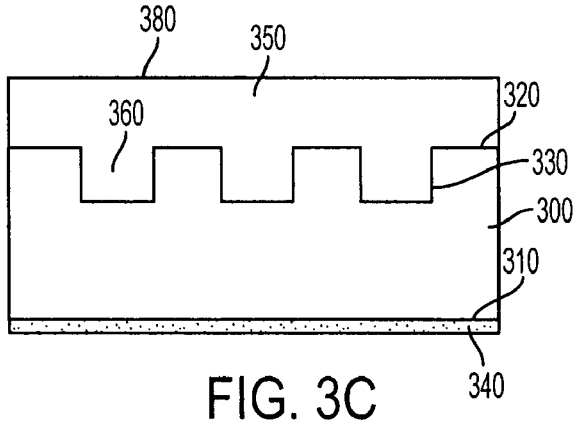

Subsequently, a fitter 350 is formed which contains a surface pattern opposite to the polishing pattern. As shown in FIG. 3B, the fitter 350 comprises convexities or projections 360 which fit directly into the apertures 330 while projections 320 on the polishing pattern fit directly into corresponding apertures 370 in the surface pattern of fitter 350. Fitter 350 has an outer surface 380, opposite to the surface pattern, which is essentially coplanar and parallel to the back surface 310 of polishing layer 300.

A pressure sensitive adhesive 340 is then applied to the back surface 310 of polishing layer 300 by applying pressure, as by rolling. During the application of pressure, since surface 380 of the fitter is essentially parallel to back surface 310 of polishing layer 300, and the polishing pattern is interlocked with the fitter surface pattern, substantially equal pressure is applied across the entire interface between adhesive layer 340 and back surface 310. Subsequently, the fitter 350 is removed from the polishing surface of the polishing layer 300, as by mechanical extraction.

Figure 3D:
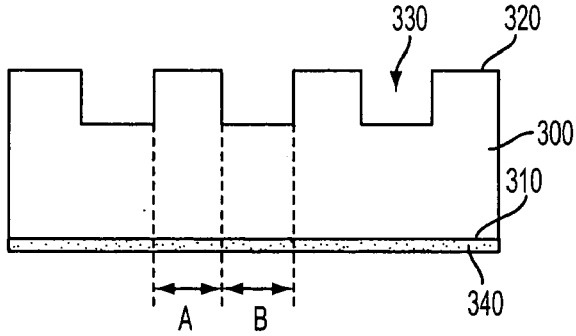

The thus formed polishing pad is illustrated in FIG. 3D. As a result of applying substantially uniform pressure across the interface while adhering the adhesive layer 340 to the back surface 310 of polishing layer 300, the adhesive strength at the interface between the back surface 310 of polishing layer 300 and adhesive layer 340 underlying apertures 330 (B) is substantially the same as the adhesive strength at the interface underlying projections 320 (A). In the embodiment illustrated in FIGS. 3A through 3D, a double-sided adhesive tape, such as that illustrated in FIG. 2, can be employed. Alternatively, instead of applying uniform pressure across the interface between back surface 310 and adhesive layer 340, a first pressure applied to the regions corresponding to apertures 330 (B) is higher than a second pressure applied to the regions corresponding to projections 320 (A). Thereby, the first adhesive strength at the interface between back surface 310 and adhesive layer 340 underlying apertures 330 (B) is higher than the second adhesive strength at the interface underlying projections 320 (A). In an embodiment, the first adhesive strength is higher than the second adhesive strength by at least 5%, such as 10% to about 40%.

Figure 4A:
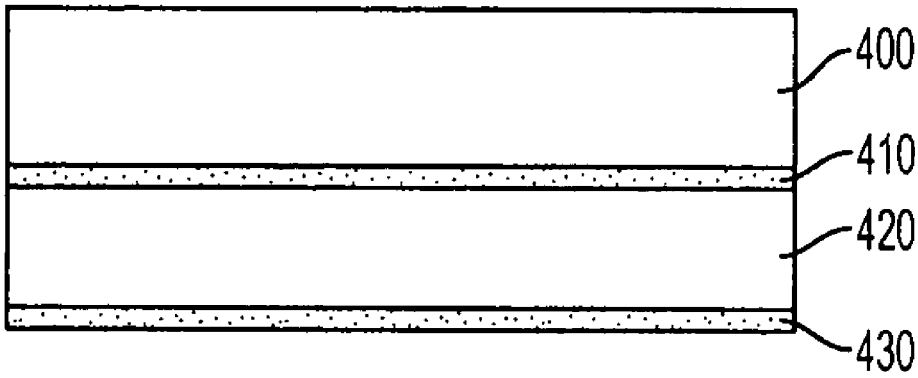
FIGS. 4A and 4B are side sectional views schematically illustrating sequential phases of a method in accordance with another embodiment of the present invention.
Figure 4B:
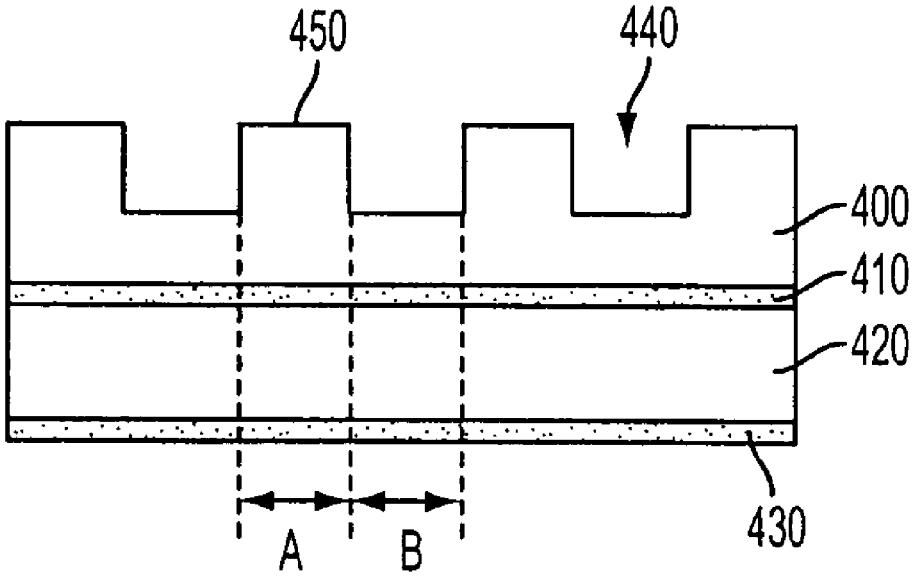

Another method in accordance with an embodiment of the present invention is schematically illustrated in FIGS. 4A and 4B. This embodiment is similar to that illustrated in FIGS. 1A and 1B, except that a composite polishing pad is formed. Adverting to FIG. 4A, a first adhesive layer 410 is applied to the back surface of a polishing layer 400 by the application of pressure, as by rolling. As polishing layer 400 has substantially parallel opposing surfaces, uniform pressure is applied across the interface between adhesive layer 410 and polishing layer 400. Adhesive layer 410 can comprise any of various double-sided adhesive tapes, such as that illustrated in FIG. 2. After the release layer is removed, a bottom layer 420 is applied to polishing layer 400 via adhesive layer 410 by application of pressure. In accordance with embodiments of the present invention, polishing layer 400 is formed with greater hardness or stiffness than bottom layer 420, while bottom layer 420 is formed with greater compliance or flexibility than polishing layer 400.

Subsequently, a second adhesive layer 430 is applied to the back surface of bottom layer 420. During application of first adhesive layer 410 to the back surface of polishing layer 400, application of bottom layer 420 to first adhesive layer 410, and application of second adhesive layer 430 to the back surface of bottom layer 420, substantially uniform pressure is applied across the respective interfaces.

Subsequently, as illustrated in FIG. 4B, polishing layer 400 is provided with a polishing pattern comprising a plurality of apertures 440 and adjacent projections 450. As uniform pressure was applied during application of the adhesive layers 410 and 430, and application of bottom layer 420, substantially uniform adhesion exists across the interfaces between first adhesive layer 410 and polishing layer 400, between bottom layer 420 and first adhesive layer 410, and between second adhesive layer 430 and bottom layer 420, including substantially uniform adhesion in areas underlying apertures 440 (B) and areas underlying projections 450 (A). Alternatively, during application of first adhesive layer 410 to the back surface of polishing layer 400, application of bottom layer 420 to first adhesive layer 410, and application of second adhesive layer 430 to the back surface of bottom layer 420, instead of applying uniform pressure across the respective interfaces, a first pressure applied to the regions predetermined to form apertures 440 (B) is higher than a second pressure applied to the regions predetermined to form projections 450 (A). Thereby, the first adhesive strength at the respective interfaces underlying apertures 440 (B) is higher than the second adhesive strength at the respective interfaces underlying projections 450 (A). In an embodiment, the first adhesive strength is higher than the second adhesive strength by at least 5%, such as 10% to about 40%. Embodiments of the present invention are not limited to polishing pads having two layers, but include multiple layers, such as 3, or more layers, each having designed properties.

Figure 5A:
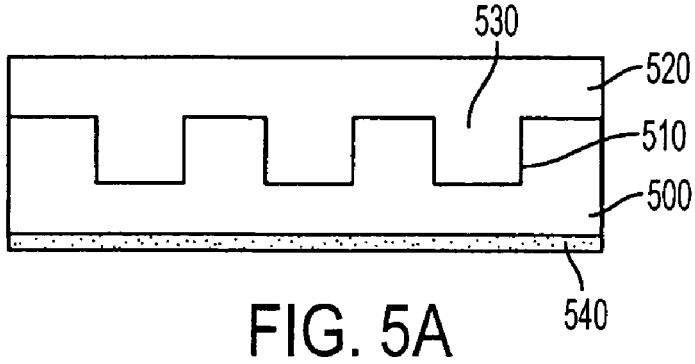
FIGS. 5A through 5C are side sectional views schematically illustrating sequential phases of a method in accordance with another embodiment of the present invention.
Figure 5B:
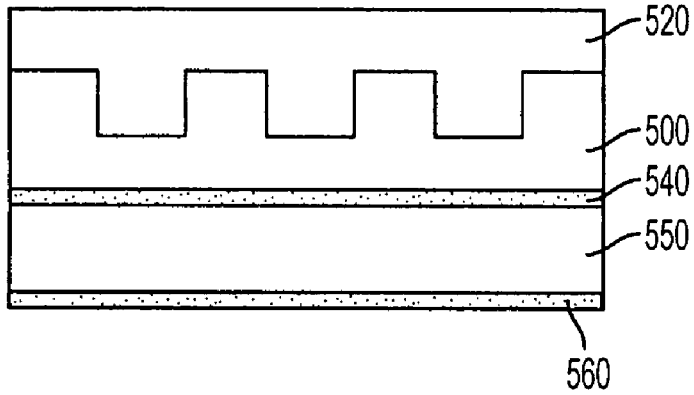
Figure 5C:
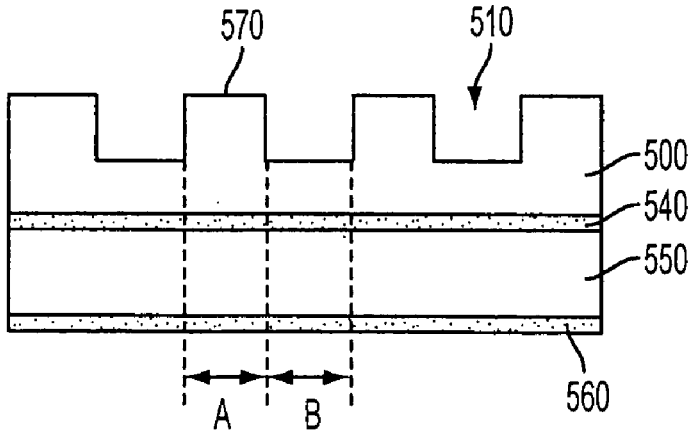
Figure 6A:
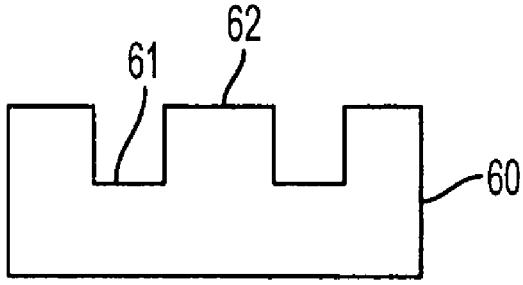
FIG. 6A PRIOR ART
FIGS. 6A and 6B are side sectional views schematically illustrating sequential phases of a conventional method.
Figure 6B:
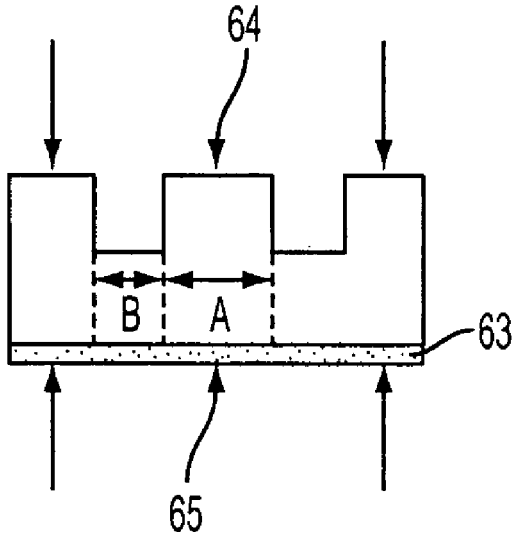
FIG. 6B PRIOR ART

Another method in accordance with an embodiment of the present invention is schematically illustrated in FIGS. 5A through 5C. Adverting to FIG. 5A, which appears similar to FIG. 3C, a polishing layer 500 having a surface pattern of apertures and projections is provided with a fitter 520 having a plurality of projections 530 fitting snugly within apertures 510 of the polishing pattern. Subsequently, first adhesive layer 540 is applied to the back surface of polishing layer 500. As the back surface of polishing layer 500 and opposing surface of fitter 520 are substantially parallel and the fitter is tightly within the polishing pattern, uniform pressure is applied across the entire interface between first adhesive layer 540 and the back surface of polishing layer 500. After removal of the release layer from first adhesive layer 540, a bottom layer 550 is adhered to first adhesive layer 540 by the application of uniform pressure across the interface therebetween. Subsequently, a second adhesive layer 560 is applied to the mounting surface of bottom layer 550 by the application of uniform pressure across the interface therebetween. As uniform pressure was applied across the respective interfaces when bonding first adhesive layer 540 to polishing layer 500, bottom layer 550 to first adhesive layer 540 and second adhesive layer 560 to bottom layer 550, substantially uniform adhesion exists across those interfaces, including regions underlying apertures 510 (B) and adjacent regions underlying projections 570 (A). Alternatively, during application of first adhesive layer 540 to the back surface of polishing layer 500, application of bottom layer 550 to first adhesive layer 540, and application of second adhesive layer 560 to the back surface of bottom layer 550, instead of applying uniform pressure across the respective interfaces, a first pressure applied to the regions corresponding to apertures 510 (B) is higher than a second pressure applied to the regions corresponding to projections 570 (A). Thereby, the first adhesive strength at the respective interfaces underlying apertures 510 (B) is higher than the second adhesive strength at the respective interfaces underlying projections 570 (A). In an embodiment, the first adhesive strength is higher than the second adhesive strength by at least 5%, such as 10% to about 40%. As in the embodiment illustrated in FIGS. 4A and 4B, polishing layer 500 can comprise a material having a relatively high degree of hardness or stiffness, while bottom layer 550 can comprise a material having a relatively high degree of compliance or flexibility. Further, multiple layered polishing pads can be formed with 3, or more layers, each having designed properties.

In embodiments of the present invention, any commercially available pressure sensitive adhesive can be employed, such as the double-sided adhesive tape illustrated in FIG. 2. The polishing patterns on the polishing layer can be formed by any technique, such as mechanical, or chemical techniques. The materials employed for layers of the polishing pads in embodiments of the present invention can be any material employed in the fabrication of polishing pads, such as various thermoplastic or thermosetting polymers, such as urethane polymers, polycarbonates, polybutadienes, polyethylenes, polystyrenes, polypropylenes, polyesters and polyacrylamides. The polishing pad components of the present invention, i.e., polishing layer and bottom layers, can be fabricated by techniques, such as thermoplastic injection molding, thermoset injection molding, or compression molding. Embodiments of the present invention comprise various types of composite polishing pads with plural bottom layers designed with different mechanical properties to achieve targeted performance characteristics. In embodiments of the present invention, for adhering process, applying different pressures predetermined to form (or corresponding to) projections (A) and apertures (B) can be accomplished by a pressurizing machine with multi pressure controlling zones.

The present invention advantageously enables the fabrication of polishing pads having a surface polishing pattern comprising at least one concavity or aperture, and an adhesive layer bonded to the opposite surface with substantially uniform adhesive strength throughout the entire interface. For example, the present invention enables the fabrication of polishing pads having an adhesive layer bonded to the mounting surface of a polishing pad with an adhesive strength that does not vary by more than 45% across the entire interface, e.g., an adhesive strength which does not vary by more than 50% across the entire interface. Adverting to FIGS. 1B, 3D, 4B and 5C, polishing pads produced in accordance with embodiments of the present invention exhibit substantially uniform adhesive strength at the interfaces between applied layers underlying apertures in the polishing pattern (B) and in areas underlying projections (A). For example, polishing pads fabricated in accordance with embodiments of the present invention exhibit an adhesive strength at interfaces in regions under area A and area B which does not vary by more than 45%, e.g., an adhesive strength which does not vary by more than 50%. For another example, polishing pads fabricated in accordance with embodiments of the present invention exhibit a first adhesive strength at interfaces in regions under area B higher than a second adhesive strength at interfaces in regions under area A by at least 5%, such as 10% to about 40%.

The present invention enables the fabrication of polishing pads containing an adhesive layer applied to the mounting surface such that during CMP, delamination and consequential damage to wafers undergoing processing is avoided. The present invention enjoys utility in the fabrication of any of various types of polishing pads designed for various types of CMP on various types of layers during the fabrication of integrated circuits, such as metal layers, polycrystalline silicon layers, insulating or dielectric layers, and combinations thereof. The present invention, therefore, enjoys industrial applicability during CMP in fabricating various types of semiconductor chips, including chips having highly integrated semiconductor devices, including memory semiconductor devices, with high dimensional accuracy.

In the preceding description, the present invention is described with reference to specifically exemplary embodiments thereof. It will, however, be evident that various modifications and changes may be made thereto without departing from the broader spirit and scope of the present invention, as set forth in the claims. The specification and drawings are, accordingly, to be regarded as illustrative and not as restrictive. It is understood that the present invention is capable of using various other combinations and embodiments and is capable of any changes or modifications within the scope of the inventive concept as expressed herein.

What is claimed is:

1. A method of fabricating a polishing pad, the method comprising sequentially:

providing a polishing layer having a polishing surface and a back surface opposing the polishing surface;

adhering a first adhesive layer to the back surface; and forming a polishing pattern having at least one aperture and at least one projection on the polishing surface, wherein the first adhesive layer comprises a pressure sensitive adhesive.

2. The method according to claim 1, comprising providing the polishing layer with a planar polishing surface before adhering the first adhesive layer to the back surface.

3. The method according to claim 1, comprising adhering the first adhesive layer to the back surface by applying pressure.

4. The method according to claim 3, further comprising:

adhering the first adhesive layer to the back surface by applying a first pressure to the region predetermined to form the aperture and applying a second pressure to the region predetermined to form the projection, wherein the first pressure is higher than the second pressure.

5. The method according to claim 3, comprising:

adhering a bottom layer to the first adhesive layer by applying pressure; and adhering a second adhesive layer to the bottom layer.

6. The method according to claim 5, further comprising:

adhering the bottom layer to the first adhesive layer by applying a third pressure to the region predetermined to form the aperture and applying a fourth pressure to the region predetermined to form the projection, wherein the third pressure is higher than the fourth pressure.

7. The method according to claim 5, wherein the second adhesive layer comprises a pressure sensitive adhesive, the method comprising:

adhering the second adhesive layer to the bottom layer by applying pressure.

8. The method according to claim 7, further comprising:

adhering the second adhesive layer to the bottom layer by applying a fifth pressure to the region predetermined to form the aperture and applying a sixth pressure to the region predetermined to form the projection, wherein the fifth pressure is higher than the sixth pressure.

9. A polishing pad produced by the method of claim 1.

10. A method of fabricating a polishing pad, the method comprising:

providing a polishing layer having a polishing surface and a back surface opposing the polishing surface;

forming a polishing pattern having at least one aperture and at least one projection on the polishing surface;

forming a fitter having a first surface, comprising a surface pattern opposite to the polishing pattern including at least one projection, and a second surface opposing the first surface;

aligning the fitter with the polishing pattern such that the projection on the first surface of the fitter is aligned with the aperture on the polishing surface; and adhering a first adhesive layer to the back surface of the polishing layer.

11. The method according to claim 10, wherein the second surface of the fitter is substantially planar, the method comprising aligning the fitter by fitting the surface pattern into the polishing pattern such that the projection of the fitter is within the aperture on the polishing surface and the second surface of the fitter is substantially parallel to the back surface of the polishing layer.

12. The method according to claim 10, wherein the first adhesive layer comprises a pressure sensitive adhesive, the method comprising adhering the first layer to the back surface of the polishing layer by applying pressure.

13. The method according to claim 12, further comprising:

adhering the first layer to the back surface of the polishing layer by applying a first pressure to the region corresponding to the aperture on the polishing surface and applying a second pressure to the region corresponding to the projection on the polishing surface, wherein the first pressure is higher than the second pressure.

14. The method according to claim 10, further comprising:

removing the fitter.

15. The method according to claim 10, further comprising:

adhering a bottom layer to the first adhesive layer by applying pressure; and adhering a second adhesive layer to the bottom layer.

16. The method according to claim 15, further comprising:

adhering the bottom layer to the first adhesive layer by applying a third pressure to the region corresponding to the aperture on the polishing surface and applying a fourth pressure to the region corresponding to the projection on the polishing surface, wherein the third pressure is higher than the fourth pressure.

17. The method according to claim 15, wherein the second adhesive layer comprises a pressure sensitive adhesive, the method comprising:

adhering the second adhesive layer to the bottom layer by applying pressure.

18. The method according to claim 17, further comprising:

adhering the second adhesive layer to the bottom layer by applying a fifth pressure to the region corresponding to the aperture on the polishing surface and applying a sixth pressure to the region corresponding to the projection on the polishing surface, wherein the fifth pressure is higher than the sixth pressure.

19. A polishing pad produced by the method of claim 10.

20. A method of fabricating a polishing pad, the method comprising:

forming a polishing layer comprising a back surface and an opposing polishing surface having a polishing pattern with at least one concave surface portion ("B") between adjacent convex surface portions ("A"); and adhering an adhesive layer to the bottom surface by applying greater pressure to portion B than to portions A.

21. A polishing pad produced by the method of claim 20.

22. A polishing pad comprising:

a polishing layer having a first surface and an opposing second surface, the first surface having a polishing pattern formed thereon, the polishing pattern comprising at least one concave surface portion between adjacent convex surface portions; and an adhesive layer adhered to the second surface forming an interface therebetween, wherein adhesive strength across the interface does not vary by more than 45%.

23. The polishing pad according to claim 22, wherein the adhesive strength does not vary by more than 50%.

24. A polishing pad comprising:

a polishing layer having a first surface with a polishing pattern formed thereon and an opposing second surface, the polishing pattern comprising at least one concave surface portion ("B") between adjacent convex surface portions ("A");

and an adhesive layer adhered to the second surface forming an interface therebetween, wherein the adhesive strength at the interface underlying portions A and portion B does not vary by more than 45%.

25. The polishing pad according to claim 24, wherein the adhesive strength does not vary by more than 50%.

26. A polishing pad comprising:

a polishing layer having a first surface with a polishing pattern formed thereon and an opposing second surface, the polishing pattern comprising at least one concave surface portion ("B") between adjacent convex surface portions ("A"); and an adhesive layer adhered to the second surface forming an interface therebetween, wherein a first adhesive strength at the interface underlying portion B is higher than a second adhesive strength at the interface underlying portions A by at least 5%.

27. The polishing pad according to claim 26, wherein the first adhesive strength is higher than the second adhesive strength by at least 10% to 40%.

28. A method of fabricating a polishing pad, the method comprising:

forming a polishing layer comprising a back surface and an opposing polishing surface, the polishing surface consisting of a polishing pattern with at least one convex surface portion ("A") and at least one adjacent concave surface portion ("B"); and adhering an adhesive layer to the bottom surface by applying greater pressure to portion B than to portion A.

* * * * *